US008589092B2

(12) United States Patent
Plouffe et al.

(10) Patent No.: US 8,589,092 B2
(45) Date of Patent: Nov. 19, 2013

(54) NON INTERRUPTING ON-LINE WATER DISTRIBUTION PRESSURE MONITORING SYSTEM FOR COMPRESSION TYPE WET AND DRY BARREL FIRE HYDRANTS

(75) Inventors: Don Plouffe, Chatham (CA); Rick Nissen, Chatham (CA)

(73) Assignee: 2236128 Ontario Inc., Guelph (CA)

( * ) Notice: Subject to any disclaimer, the term of this patent is extended or adjusted under 35 U.S.C. 154(b) by 636 days.

(21) Appl. No.: 12/827,318

(22) Filed: Jun. 30, 2010

(65) Prior Publication Data

US 2012/0004866 A1 Jan. 5, 2012

(51) Int. Cl.
*G01F 17/00* (2006.01)
*E03B 9/02* (2006.01)
*E03F 7/00* (2006.01)

(52) U.S. Cl.
CPC .... *E03B 9/02* (2013.01); *E03F 7/00* (2013.01)
USPC ..... 702/50; 73/1.57

(58) Field of Classification Search
CPC ..... E03B 9/02; E03F 7/00; A62C 35/20; A62C 35/62; A62C 35/64
USPC ..... 702/50; 73/1.57
See application file for complete search history.

(56) References Cited

U.S. PATENT DOCUMENTS

| | | | | |
|---|---|---|---|---|
| 4,335,608 | A * | 6/1982 | Wood et al. | 73/753 |
| 6,816,072 | B2 * | 11/2004 | Zoratti | 340/540 |
| 7,099,781 | B1 | 8/2006 | Heidl | |
| 7,124,036 | B2 | 10/2006 | Rigby et al. | |
| 7,373,261 | B2 | 5/2008 | Heidl et al. | |
| 2002/0148294 | A1 * | 10/2002 | Bond | 73/592 |
| 2007/0255515 | A1 | 11/2007 | Hoehner et al. | |
| 2008/0281534 | A1 | 11/2008 | Hurley | |
| 2009/0133887 | A1 * | 5/2009 | Garcia et al. | 169/54 |
| 2010/0156632 | A1 * | 6/2010 | Hyland et al. | 340/540 |
| 2010/0212396 | A1 * | 8/2010 | Zenisek | 73/1.57 |
| 2011/0168265 | A1 * | 7/2011 | Cheney et al. | 137/1 |

FOREIGN PATENT DOCUMENTS

| | | | |
|---|---|---|---|
| FR | 2792070 | A1 | 10/2000 |
| GB | 614963 | A | 12/1948 |
| JP | 2291917 | A | 12/1990 |

* cited by examiner

*Primary Examiner* — Sujoy Kundu
*Assistant Examiner* — Timothy H Hwang
(74) *Attorney, Agent, or Firm* — Lorelei G. Graham

(57) ABSTRACT

A non interrupting on-line water distribution pressure monitoring system for a dry barrel fire hydrant includes an upper portion or the head and a lower portion or the barrel having an opening. A water flow control mechanism mounted at the opening of the lower portion of the barrel for controlling the water flowing through the barrel. An operating rod for activating the water flow control mechanism having an upper operating rod and a lower operating rod extends through the barrel between the upper and lower portions. The upper operating rod is secured to the head and the bottom of the lower operating rod is secured through the water flow control mechanism to extend beyond the lower portion of the barrel. A water pressure measuring device is housed within the bottom of the lower operating rod and extending beyond the bottom of the lower operating rod. A communication mechanism is positioned remotely from the dry barrel fire hydrant for receipt, collection and distribution of information collected from the water pressure measuring device.

14 Claims, 4 Drawing Sheets

NON INTERRUPTING ON-LINE WATER DISTRIBUTION PRESSURE MONITORING SYSTEM FOR COMPRESSION TYPE WET AND DRY BARREL FIRE HYDRANTS

FIELD OF THE INVENTION

This invention relates in general to the ability to monitor water distribution system pressure through a dry barrel fire hydrant or in a wet barrel fire hydrant and more particularly to a continuous on-line water distribution pressure monitoring system operational year round.

BACKGROUND OF THE INVENTION

The ability to monitor water distribution system pressure through fire hydrants allows for water utilities to monitor pressure drops caused by water main breaks, excessive flow, hydrant activation, etc. as well as gathering general hydraulic data on the system. Typically monitoring water distribution system pressure through a fire hydrant is conducted when the fire hydrant is not in use.

Prior art monitoring systems for fire hydrants have been devised to address some of the problems. For example, U.S. Pat. No. 7,373,261 issued on May 13, 2008 to Heidl et al. relates to the meter system having a portable water meter that is releaseably mountable onto a discharge nozzle of the fire hydrant and a flow sensor that senses the water flow rate passing there through the portable water meter. A processor receives, processes, and/or stores data from the flow sensor and a satellite positioning system. The hydrant meter system further has a communication device that is adapted to transmit the processed flow signal and the processed positioning signal to a remote server system via a communication medium. The hydrant meter system allows for automated water utility resource measurements, data collection and exercise of control and notification of fire hydrant water usage.

Heidl is also the owner of U.S. Pat. No. 7,099,781 which issued on Aug. 29, 2006. This patent relates to the meter system of the present invention allows for automated water utility resource measurements, data collection and exercise of control and notification of fire hydrant water usage and includes a portable water meter that is releaseably mountable onto a discharge nozzle of the fire hydrant; a flow sensor that senses the water flow rate passing there through the portable water meter; a processor that is configured to receive, process, and/or store data from the flow sensor; and a satellite positioning system that is adapted to receive satellite position determining signals. The hydrant meter system further includes a communication device that is adapted to transmit the processed flow signal and the processed positioning signal to a remote server system via a communication medium.

U.S. Pat. No. 6,816,072 which issued on Nov. 9, 2004 to Zoratti relates to a detection and signalling apparatus is mountable in a fire hydrant to detect a parameter, such as unauthorized movement of a discharge nozzle cap relative to the fire hydrant. A housing carrying a sensor, such as a motion detector, is mounted inside of the cap. The sensor has an output connected to a transmitter. Movement of the cap relative to the fire hydrant activates the motion detector which generates an output signal causing the transmitter to remotely transmit a tamper detection signal and, also, a fire hydrant location identification code. A pressure sensor can also be coupled to the transmitter to sense water supply main pressure and water flow through the fire hydrant.

U.S. Pat. No. 7,124,036 which issued on Oct. 17, 2006 to Rigby et al. relates to the demand of a water distribution system which is determined by the steps of measuring the volume of water flowing into the water distribution system through an input during a predetermined interval of time, measuring the change in the volume of water stored in the storage reservoir during the same time interval, measuring the volume of water flow exiting the water distribution system through an output during the same time interval, calculating an adjusted input measurement by subtracting the measured flow of water exiting the water distribution system from the measured volume of water flow into the water distribution system, and adding a measured increase in the volume of the water in the storage reservoir to the adjusted input measurement or subtracting a measured decrease in the volume of water in the storage reservoir from the adjusted input measurement to determine the demand.

Finally Hoehner et al. is the owner of U.S. Patent Appln. Publication No. 2007/0255515 which was filed on May 1, 2007 and relates to methods, systems, and computer program products for automatically detecting leaks in a type III hydrant fuel piping system is described. In one embodiment, the method includes automatically actuating one or more valves to isolate a hydrant loop of a type III hydrant fuel piping system from the remainder of the system. The pressure in the hydrant loop is varied. The pressure in the hydrant loop is measured over time in response to the varying of the pressure.

Thus a non interrupting on-line water distribution pressure monitoring system for a fire hydrant which provides year round monitoring of water distribution system pressure through the fire hydrant, may be used with both wet and dry barrel types, and may be operated while the fire hydrant is in use thereby avoiding interruption to operation during use, and this application can be used in both hot and cold climates.

SUMMARY OF THE INVENTION

An object of one aspect of the present invention is to provide an improved non interrupting on line water distribution pressure monitoring system operational year round for either a wet or dry barrel fire hydrant.

In accordance with one aspect of the present invention there is provided a non interrupting on-line water distribution pressure monitoring system for a dry barrel fire hydrant. The non interrupting on-line water distribution pressure monitoring system for a dry barrel fire hydrant includes an upper portion or the head and a lower portion or the barrel having an opening. A water flow control mechanism mounted at the opening of the lower portion of the barrel for controlling the water flowing through the barrel. An operating rod for activating the water flow control mechanism having an upper operating rod and a lower operating rod extends through the barrel between the upper and lower portions. The upper operating rod is secured to the head and the bottom of the lower operating rod is secured through the water flow control mechanism to extend beyond the lower portion of the barrel. A water pressure measuring device is housed within the bottom of the lower operating rod and extending beyond the bottom of the lower operating rod. A communication mechanism is positioned remotely from the dry barrel fire hydrant for receipt, collection and distribution of information collected from the water pressure measuring device.

Conveniently, the bottom of the lower operating rod has a hollow portion to allow for the water pressure measuring device to be housed within the lower operating rod. Preferably, the water pressure measuring device is a submersible pressure transducer and transducer cable.

In accordance with another aspect of the present invention there is provided a non interrupting on-line water distribution pressure monitoring system for a wet barrel fire hydrant having an upper portion or the head and a lower portion or the barrel having an adaptor that passes through the wall of the lower portion or the barrel. A water pressure measuring device for measuring pressure having a sensing end and cable end, and is mounted within the adaptor whereby the sensing end extends into the pressurized barrel and the cable end is outside of the pressurized barrel. A communication mechanism is positioned remotely from the wet barrel fire hydrant for receipt, collection and distribution of information collected from the sensing end of the water pressure measuring device.

In accordance with another aspect of the present invention there is provided a non interrupting on-line water distribution pressure monitoring system for a dry barrel fire hydrant having an upper portion (the head) and a lower portion (the barrel) having an opening. A water flow control mechanism is mounted at the opening of the lower portion of the barrel for controlling the water flowing through the barrel. An operating rod for activating the water flow control mechanism having an upper operating rod and a lower operating rod extends through the barrel between the upper and lower portions. The upper operating rod is secured to the head and the lower operating rod is secured through the water flow control mechanism to extend beyond the lower portion of the barrel. A water pressure measuring device for measuring pressure is housed within the lower operating rod and extending beyond the bottom of the lower operating rod. A communication mechanism is housed outside of the dry barrel fire hydrant for receipt, collection and distribution of information collected from the water pressure measuring device.

Advantages of the present invention are that the monitoring of the water pressure is continuous and therefore can be maintained while the fire hydrant is in operation or use, a special concrete chamber located off the central main is not required to house the system saving in construction costs, the system is not susceptible to freezing and therefore can be used in both warm and cold climates, the ability to monitor continuously the pressure of the water main through both dry barrel or wet barrel fire hydrants, provides real-time or historical data, alerts operators to abnormal pressures caused by possible water main breaks, etc., and/or the operation of the hydrant.

BRIEF DESCRIPTION OF THE DRAWINGS

A detailed description of the preferred embodiments is provided herein below by way of example only and with reference to the following drawings, in which.

Figure 1:
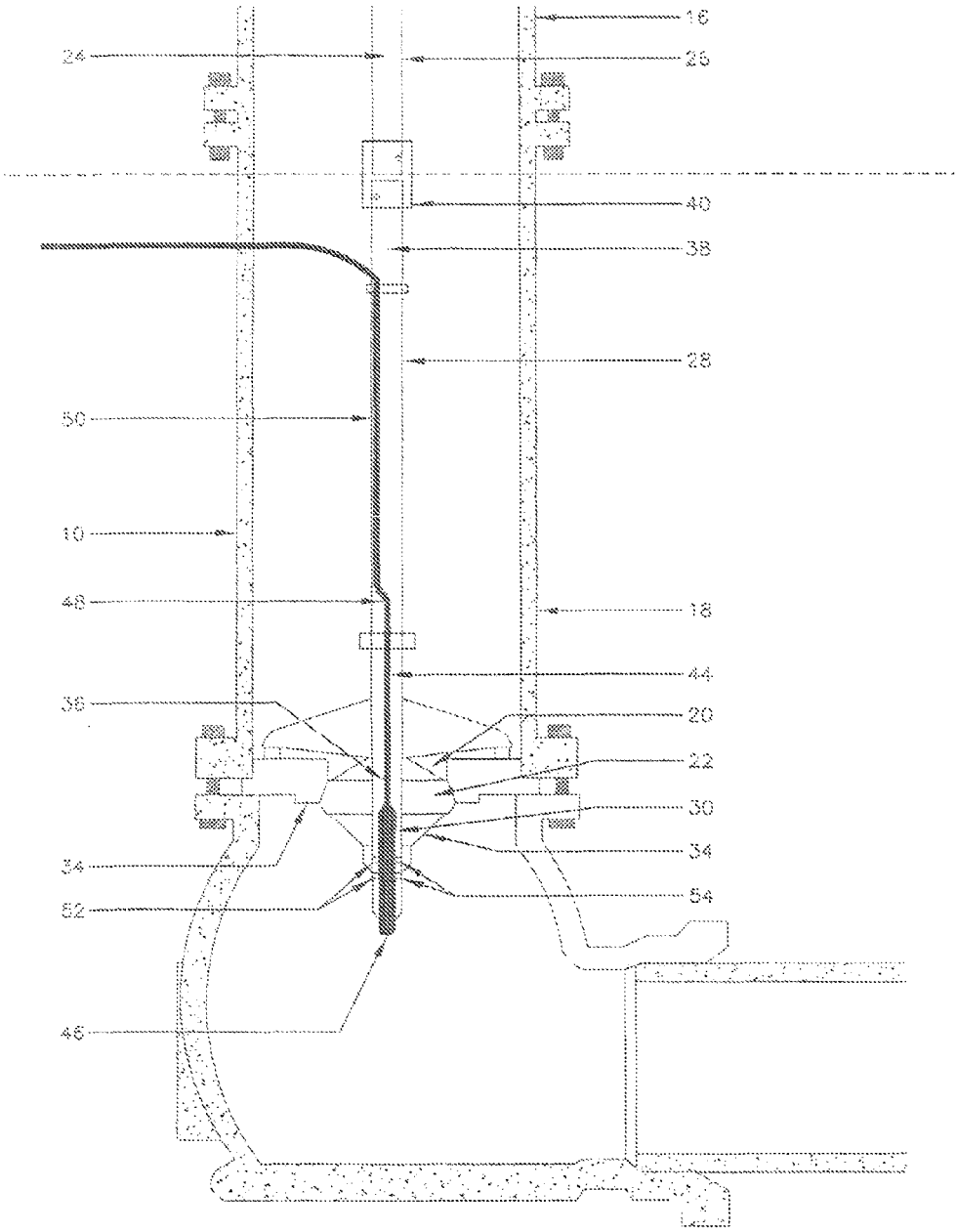
FIG. 1 in a partial cut-away view, illustrates a non interrupting on-line water distribution pressure monitoring system for a dry barrel fire hydrant in accordance with a preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Fire hydrants typically are either dry barrel hydrant used in colder climates or wet barrel hydrants for warm climates. Due to the construction of a typical fire hydrant and limitations based on climate (freezing), it is difficult to get accurate data with respect to water distribution and water pressure. For years the construction and operation of dry barrel compression type hydrants has not changed significantly. These hydrants generally consist of the bonnet, head, barrel, boot, operating rod, and the ball and seat assembly. The rotation of the operating nut located on top of the head bonnet will either raise or lower the operating rod, in turn seating or unseating the ball from the seat causing water to flow or stop flowing through the fire hydrant.

Water distribution systems are normally designed with hydrant placements typically every 500 feet. All hydrants are piped to the water main through a hydrant lead or a hydrant lateral, usually 6" in diameter or greater. The fire hydrant lead feeds the hydrant only from the main, no other lines should be connected this feed therefore eliminating pressure monitoring interferences.

One of the most important operating parameters within water distribution systems is the monitoring and control of system water pressure. Excessive water pressure increases the risk of structural damage to the conveying materials within the pressure zone area. Conversely the presence of low system pressure elevates the risk of backflow conditions which in turn could compromise water quality. Low pressure could also have a detrimental affect on manufacturing facilities, hospitals, fire fighting capability by way of example only. Therefore the ability to monitor the water distribution system contributes to disaster prevention as it can provide real-time modeling of the capacity in a system. This can be a significant asset for urban planning activities such as planning a subdivision. As such the ability to continuously monitor water distribution pressure in the water distribution system via a fire hydrant would potentially reduce the risks noted above.

As fire hydrants are conveniently located they are the obvious vehicle to use for monitoring. Fire hydrants are however in constant use so water pressure monitoring can be hampered using traditional devices. Traditional devices require that the fire hydrant be partially dismantled to have water distribution assessed. Also due to the nature of most dry barrel hydrants, access to the hydrant is really restricted to the summer and can not occur in the winter. The instant device allows a fire hydrant to be in use while still being able to monitor water distribution and pressure. This ability is incredibly valuable during emergency situations as it provides a real-time snap shot of the availability of water in the system. Furthermore the instant invention allows for access to the required information year round and is not restricted to the summer or when the hydrant is not in use. Finally the instant invention is a cost effective as it does not require extensive retrofitting or refurbishing which can be costly to municipalities.

Figure 2:
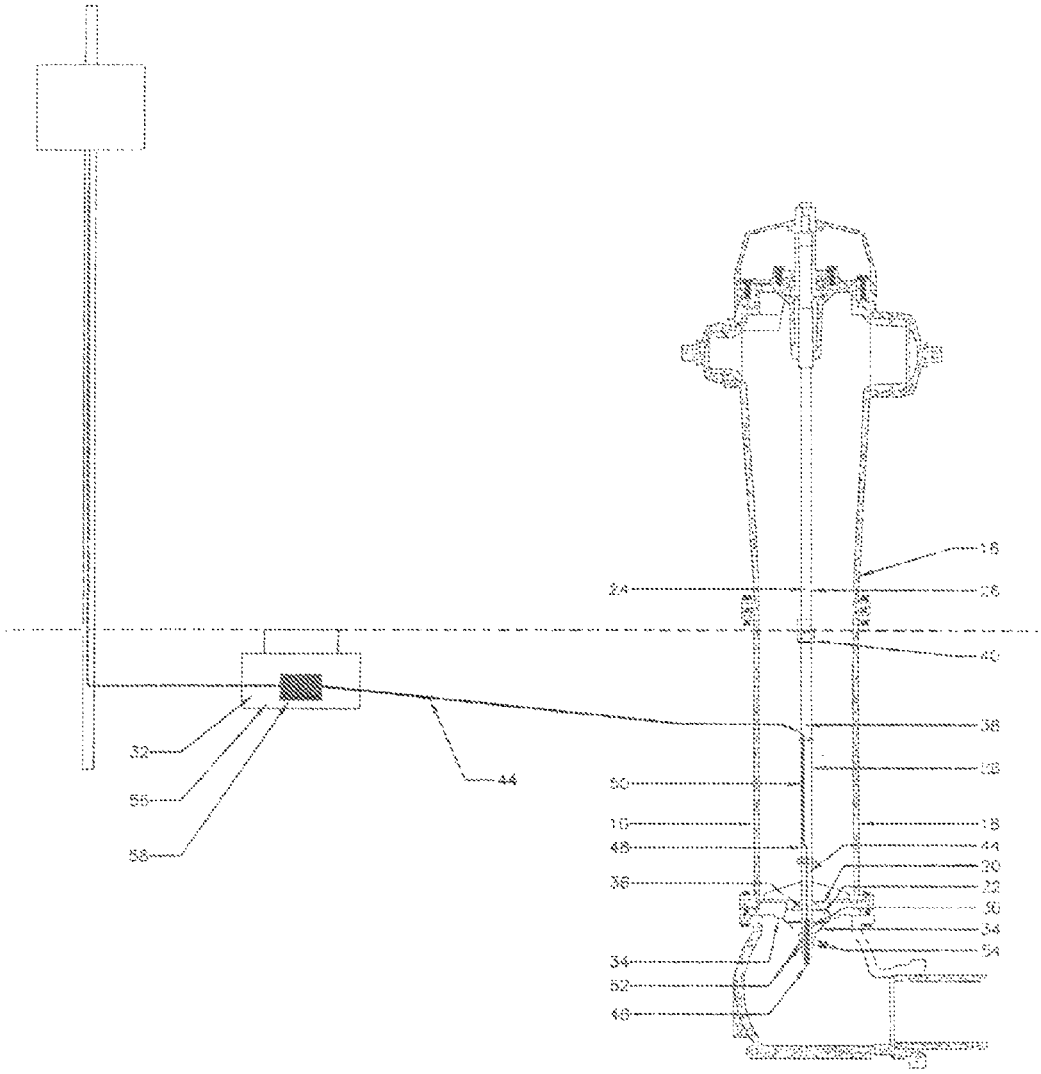
FIG. 2 in a schematic view, illustrates the non interrupting on-line water distribution pressure monitoring system for a dry barrel fire hydrant of FIG. 1.

Referring to FIGS. 1 and 2, there is illustrated in a partial cut-away view and a schematic, a non interrupting on-line water distribution pressure monitoring system for a dry barrel fire hydrant 10 in accordance with a preferred embodiment of the present invention. The non interrupting on-line water distribution pressure monitoring system for a dry barrel fire hydrant 10 includes an upper portion or the head 16 and a lower portion or the barrel 18 having an opening 20. A water flow control mechanism 22 is mounted at the bottom opening 20 of the barrel 18 for controlling the water flowing through the barrel 18. An operating rod 24 for activating the water flow control mechanism 22 having an upper operating rod 26 and a lower operating rod 28 extends through the barrel 18 to the upper portion the head 16 of the hydrant 10. The upper operating rod 26 is secured to the head 16 and the lower operating rod 28 is secured through the water flow control mechanism 22 to extend beyond the bottom end of the barrel 18.

A water pressure measuring device 30 is housed within the lower operating rod 28 and extends beyond the bottom of the lower operating rod 28. A communication mechanism 32 positioned remotely from the dry barrel fire hydrant for receipt, collection and distribution of information collected from the water pressure measuring device 30.

The water flow control mechanism 22 may be further defined as a ball and seat assembly 34 by way of example only. The bottom of the lower operating rod 28 actually extends through the ball and seat assembly 34. The bottom of the lower operating rod 28 has a hollow portion 36 to allow for the water pressure measuring device 30 to be housed within the bottom of the lower operating rod. Lower operating rod 28 will be a stainless steel rod that are traditionally either round or square in configuration depending on the hydrant manufacturer. Furthermore the use of stainless steel results in lower maintenance costs as the rod does not need to be replaced as frequently as traditional devices. Traditionally the lower operating rod 28 has a top end 38 that is designed to be connected to the bottom of upper operating rod 24 that has a break away coupling 40 located close to ground level. The bottom of the lower operating rod 28 of the instant invention includes a hole bored 4 to 5 inches in from the bottom of the operating rod 24 to achieve the hollow portion 36.

The water pressure measuring device 30 may be further defined as a submersible pressure transducer and transducer cable 44. The submersible pressure transducer includes a transducer sensor 46. The transducer sensor 46 protrudes approximately ½ inch out the bottom of the lower operating rod 28 into the water. The lower operating rod 28 further includes apertures 48 in the hollow portion 36 to allow for the transducer cable 44 to pass from the hollow portion 36 of the operating rod 24 to the lower portion of the barrel 18. The lower operating rod 28 further includes a channel 50 for accepting and securing the transducer cable 44 to the lower operating rod 28. Typically a retainer collar or ring is used to secure the transducer cable 44 to the channel 50.

The bored end of the lower operating rod 28 further includes a series of channels 52 adjacent to the placement of the water pressure monitoring device 30 which are adapted to receive a sealing mechanism 54 for ensuring water does not flow past the pressure monitoring device 30 into the barrel 18. More specifically two channels are cut approximately 1" inside the hollow portion 36 to house the o-rings, by way of example only of the sealing mechanism 54, which form the seal required to stop the water from flowing past the submersible pressure transducer into the barrel 18 of the hydrant.

The communication mechanism 32 may be further defined as a remotely positioned ground vault 56 having a data logger 58 connected to the transducer cable 44. Furthermore the communication of data from the data logger 58 may be conducted wirelessly. As noted above, the lower operating rod 28 further includes apertures 48 in the hollow portion 36 to allow for the transducer cable 44 to pass from the hollow portion 36 of the lower operating rod 28 to the lower portion of the barrel 18. Specifically a small hole would be bored into the lower operating rod to allow the transducer cable 44 from the submersible pressure transducer to be passed through to the inside of the barrel 18 of the hydrant, then pressed into the channel 50 cut into the side of the lower operating rod 28. The transducer cable 44 would be securely fastened near the top of the lower rod 28 before exiting through the wall of the barrel 18 to the data logger 58 located inside a ground vault 56 or located inside a secure container on top of a sign post. The sign post may include an antenna, and if required a box housing the data logger, batteries etc.

Figure 3:
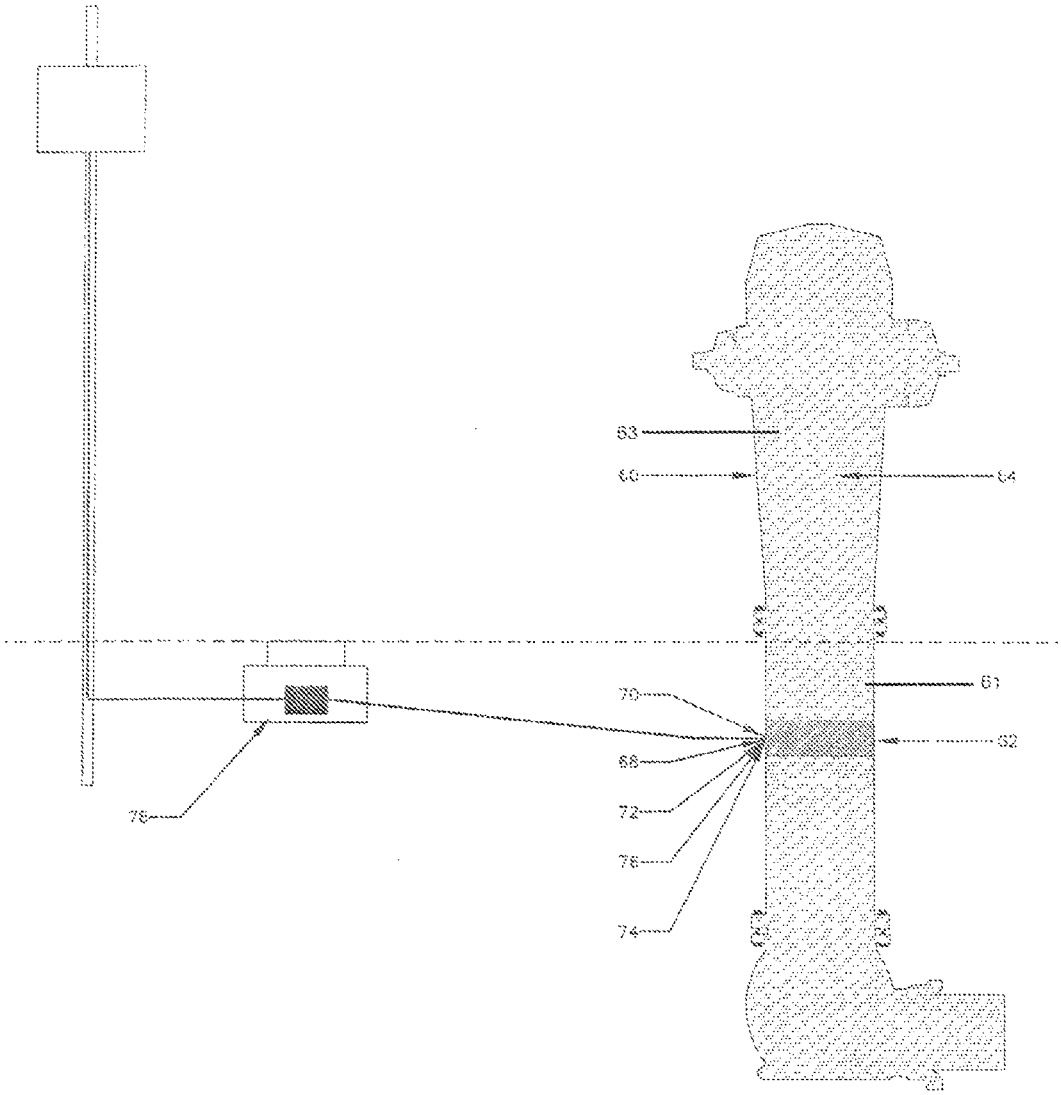
FIG. 3 in a schematic view, illustrates a non interrupting on-line water distribution pressure monitoring system for a wet barrel fire hydrant in accordance with a preferred embodiment of the present invention.

Referring to FIG. 3 in accordance with another embodiment of the present invention there is provided a non interrupting on-line water distribution pressure monitoring system for a wet barrel fire hydrant 60. Wet barrel fire hydrants do not require operating rod modification. As the wet barrel fire hydrants are continuously pressurized up to the head through the barrel, the water pressure measuring device may be positioned into the side of the hydrant barrel just below the ground. The non interrupting on-line water distribution pressure monitoring system for a wet barrel fire hydrant 60 includes an upper portion having a pressurized head 64 and a lower portion having a pressurized barrel 62 having an adaptor 70 that passes through the wall 68 of the barrel 62. The system 60 further includes a water pressure measuring device 72 for measuring pressure having a sensing end 76 and cable end 74, and mounted within the adaptor 70 whereby the sensing end 76 extends into the pressurized barrel 62 and the wire end 74 is outside of the pressurized barrel 62. A communication mechanism 78 may be positioned remotely from the wet barrel fire hydrant for receipt, collection and distribution of information collected from sensing end 76 of the water pressure measuring device 72.

The water pressure measuring device 72 may be further defined as a submersible pressure transducer with sensor and transducer cable operating similarly to the description for the dry barrel fire hydrant system noted above. The communication mechanism 78 may be in a remotely positioned ground vault having a data logger connected to the transducer cable with similar arrangements to those noted with the dry barrel fire hydrant.

Figure 4:
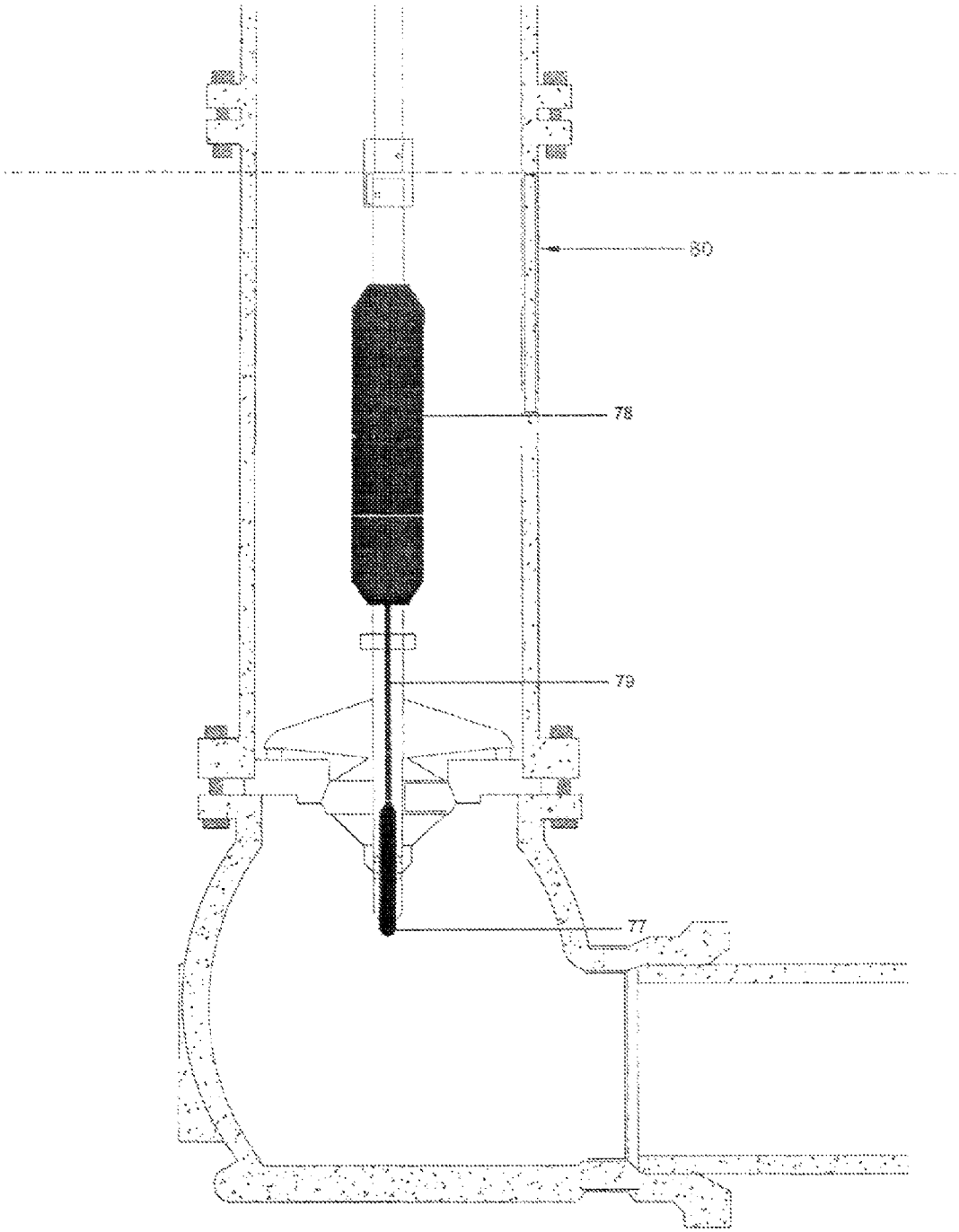
FIG. 4 in a schematic view, illustrates a non interrupting on-line water distribution pressure monitoring system for a dry barrel fire hydrant in accordance with an alternate preferred embodiment of the present invention.

Referring to FIGS. 3 and 4 in accordance with another embodiment of the present invention there is provided a non interrupting on-line water distribution pressure monitoring system for a wet barrel fire hydrant 60. Wet barrel fire hydrants do not require operating rod modification. As the wet barrel fire hydrants are continuously pressurized up to the head through the barrel, the water pressure measuring device may be positioned into the side of the hydrant barrel just below the ground. The non interrupting on-line water distribution pressure monitoring system for a wet barrel fire hydrant 60 includes an upper portion 63 having a pressurized head 64 and a lower portion 61 having a pressurized barrel 62 having an adaptor 70 that passes through the wall 68 of the barrel 62. The system 60 further includes a water pressure measuring device 72 for measuring pressure having a sensing end 76 and cable end 74, and mounted within the adaptor 70 whereby the sensing end 76 extends into the pressurized barrel 62 and the wire end 74 is outside of the pressurized barrel 62. A communication mechanism 78 may be positioned remotely from the wet barrel fire hydrant for receipt, collection and distribution of information collected from sensing end 76 of the water pressure measuring device 72.

The water pressure measuring device 72 may be further defined as a submersible pressure transducer with sensor 77 and transducer cable 79 operating similarly to the description for the dry barrel fire hydrant system noted above. The communication mechanism 78 may be in a remotely positioned ground vault having a data logger connected to the transducer cable with similar arrangements to those noted with the dry barrel fire hydrant.

Other variations and modifications of the invention are possible. All such modifications or variations are believed to be within the sphere and scope of the invention as defined by the claims appended hereto.

We claim:

1. A non interrupting on-line water distribution pressure monitoring system for a dry barrel fire hydrant comprising:

(a) an upper portion and a lower portion having an opening;

(b) a water flow control mechanism mounted at the opening of the lower portion of the barrel for controlling the water flowing through the barrel;

(c) an operating rod for activating the water flow control mechanism having an upper operating rod and a hollow lower operating rod and extends through the barrel between the upper and lower portions, the upper operating rod secured to a head and the lower operating rod secured through the water flow control mechanism to extend beyond the lower portion of the barrel in to the water;

(d) a water pressure measuring device for continuously measuring pressure housed within the hollow lower operating rod wherein the water pressure measuring device extends through the water flow control mechanism and partially beyond the lower portion of the barrel and submerged into the water thereby allowing the water to flow into the hollow lower operating rod, allowing for measurement of pressure at multiple points along the hollow lower operating rod; and (e) a communication mechanism positioned within the operating rod from the dry barrel fire hydrant for receipt, collection and distribution of information collected from the water pressure measuring device.

2. A non interrupting on-line water distribution pressure monitoring system for a dry barrel fire hydrant as claimed in claim 1 wherein the water flow control mechanism is a ball and seat assembly.

3. A non interrupting on-line water distribution pressure monitoring system for a dry barrel fire hydrant as claimed in claim 2 wherein the water pressure measuring device is a submersible pressure transducer with sensor and transducer cable.

4. A non interrupting on-line water distribution pressure monitoring system for a dry barrel fire hydrant as claimed in claim 3 wherein the lower operating rod further includes apertures in the hollow portion to allow for the transducer cable to pass from the hollow portion of the operating rod to the lower portion.

5. A non interrupting on-line water distribution pressure monitoring system for a dry barrel fire hydrant as claimed in claim 4 wherein the side of the lower operating rod further comprises a channel for accepting and securing the transducer cable to the lower operating rod.

6. A non interrupting on-line water distribution pressure monitoring system for a dry barrel fire hydrant as claimed in claim 3 wherein the bottom end of the lower operating rod further comprises a series of channels adjacent to the placement of the water pressure monitoring device which are adapted to receive a sealing mechanism for ensuring water does not flow past the pressure monitoring device into the lower portion.

7. A non interrupting on-line water distribution pressure monitoring system for a dry barrel fire hydrant as claimed in claim 3 wherein the communication mechanism is a data logger connected to the transducer cable.

8. A non interrupting on-line water distribution pressure monitoring system for a dry barrel fire hydrant as claimed in claim 3 wherein the communication mechanism is a data logger and communication with the data logger is conducted wirelessly.

9. A non interrupting on-line water distribution pressure monitoring system for a dry barrel fire hydrant comprising:

(a) an upper portion and a lower portion having an opening;

(b) a water flow control mechanism mounted at the opening of the lower portion for controlling the water flowing through the lower portion;

(c) an operating rod for activating the water flow control mechanism having an upper rod and a hollow lower rod and extends through the barrel between the upper and lower portions, the upper rod secured to a head and the lower rod secured through the water flow control mechanism to extend beyond the lower portion into the water;

(d) a water pressure measuring device for continuously measuring, collecting and sending information, wherein the water pressure measuring device extends through the water flow control mechanism and partially beyond the lower portion of the barrel and submerged into the water thereby allowing the water to flow into the hollow lower operating rod, allowing for measurement of pressure at multiple points along the hollow lower operating rod; and (e) a communication mechanism housed within the operating rod of the dry barrel fire hydrant for receipt, collection and distribution of information collected from the water pressure measuring device.

10. A non interrupting on-line water distribution pressure monitoring system for a dry barrel fire hydrant as claimed in claim 9 wherein the water flow control mechanism is a ball and seat assembly.

11. A non interrupting on-line water distribution pressure monitoring system for a dry barrel fire hydrant as claimed in claim 10 wherein the water pressure measuring device is a submersible pressure transducer with sensor and transducer cable.

12. A non interrupting on-line water distribution pressure monitoring system for a dry barrel fire hydrant as claimed in claim 11 wherein the bottom of the lower operating rod further comprises a series of channels adjacent to the placement of the water pressure monitoring device which are adapted to receive a sealing mechanism for ensuring water does not flow past the pressure monitoring device into the lower portion.

13. A non interrupting on-line water distribution pressure monitoring system for a dry barrel fire hydrant as claimed in claim 11 wherein the communication mechanism is a battery operated data logger connected to the transducer cable.

14. A non interrupting on-line water distribution pressure monitoring system for a dry barrel fire hydrant as claimed in claim 13 wherein communication with the data logger is conducted wirelessly.

* * * * *